US010323805B2

(12) United States Patent
Zhang

(10) Patent No.: US 10,323,805 B2
(45) Date of Patent: Jun. 18, 2019

(54) MODULAR LED TUBE LAMP

(71) Applicant: Kanghong Zhang, Santa Fe Springs, CA (US)

(72) Inventor: Kanghong Zhang, Santa Fe Springs, CA (US)

( * ) Notice: Subject to any disclaimer, the term of this patent is extended or adjusted under 35 U.S.C. 154(b) by 0 days.

(21) Appl. No.: 16/036,139

(22) Filed: Jul. 16, 2018

(65) Prior Publication Data

US 2019/0017663 A1 Jan. 17, 2019

Related U.S. Application Data

(60) Provisional application No. 62/533,255, filed on Jul. 17, 2017.

(51) Int. Cl.

| | |
|---|---|
| ***F21S 2/00*** | (2016.01) |
| ***F21K 9/275*** | (2016.01) |
| ***F21V 15/01*** | (2006.01) |
| ***F21K 9/278*** | (2016.01) |
| *F21Y 115/10* | (2016.01) |

(52) U.S. Cl.

CPC ..... *F21S 2/005* (2013.01); *F21K 9/275* (2016.08); *F21K 9/278* (2016.08); *F21V 15/01* (2013.01); *F21Y 2115/10* (2016.08)

(58) Field of Classification Search

CPC ..... F21S 2/005; F21K 9/278; F21K 9/275; F21V 15/01

See application file for complete search history.

(56) References Cited

U.S. PATENT DOCUMENTS

2010/0102729 A1* 4/2010 Katzir ..... H05B 33/0803 315/113

2013/0141890 A1* 6/2013 Carlin ..... F21V 23/026 362/20

* cited by examiner

*Primary Examiner* — Donald L Raleigh

(74) *Attorney, Agent, or Firm* — Clement Cheng

(57) ABSTRACT

A modular LED tube lamp has a tube lamp having a pair of ends, namely a first end and a second end. The first lamp base has a first driver, and the first lamp base is connected to the first end of the tube lamp. A second lamp base has a second driver. The second lamp base is connected to the second end of the tube lamp. A first socket receives the first lamp base; and a second socket receives the second line base. The tube lamp is linear. The tube lamp is formed in a U-shaped bend. The tube lamp is formed as a circular bend.

13 Claims, 2 Drawing Sheets

MODULAR LED TUBE LAMP

This application is a non-provisional application of and claims priority from U.S. provisional application 62/533,255 also entitled Modular LED Tube Lamp, by same inventor Kanghong Zhang, filed Jul. 17, 2017, the disclosure of which is incorporated herein by reference.

FIELD OF THE INVENTION

The present invention is in the field of lighting.

DISCUSSION OF RELATED ART

Tube lighting was popularized when fluorescent lighting was at its zenith. Historically, drivers and ballasts were mounted to the lighting fixture for powering tube lighting.

Inventor Chen-Ho Wu describes a lighting system in US Patent publication number US2007/0242466A1 entitled the Retrofitting Of Fluorescent Tubes With Light-Emitting Diode (LED) Modules For Various Signs And Lighting Applications that was published on Oct. 18, 2007. The abstract describes, "A method and device for replacing a fluorescent tube lamp with an LED lamp. The LED lamp includes an elongated electrical assembly having ends terminating in first and second electrical connectors, and a plurality of LEDs mounted to the elongated electrical assembly. Mounting adaptors connect with the first and second electrical connectors, and have protruding pins to connect with conventional lamp Socket connectors. The mounting adaptors have rotating connectors for connecting with the first and second electrical connectors of the LED lamp, so that the LED lamp orientation can be rotated after the LED lamp is fully mounted to the lamp socket connectors."

Inventor John Ivey describes a lighting system in US Patent publication number U.S. Pat. No. 8,596,813 B2 entitled Circuit Board Mount For Led Light Tube that was published on Dec. 3, 2013. The abstract describes, "Disclosed herein are embodiments of LED-based lights for replacing a conventional fluorescent light bulb in a fluorescent light fixture and embodiments of a circuit board mount for an LED-based light tube having an elongate housing with at least one circuit board spanning the housing. One embodiment disclosed herein of a circuit board mount comprises an end cap configured to fit over an open end of the housing. The end cap comprises an end wall, at least one pin connector extending through the end wall and at least one fitted slot extending from the end wall configured to receive an end of the circuit board, the at least one fitted slot having an elastic member within the at least one fitted slot configured to cushion the circuit board."

SUMMARY OF THE INVENTION

A modular LED tube lamp has a tube lamp having a pair of ends, namely a first end and a second end. The first lamp base has a first driver, and the first lamp base is connected to the first end of the tube lamp. A second lamp base has a second driver. The second lamp base is connected to the second end of the tube lamp. A first socket receives the first lamp base; and a second socket receives the second line base. The tube lamp is linear. The tube lamp is formed in a U-shaped bend. The tube lamp is formed as a circular bend.

A modular LED tube lamp includes a tube lamp that has a pair of ends, namely a first end and a second end. The tube lamp includes an array of LED elements. A first lamp base has a first driver. The first lamp base is connected to the first end of the tube lamp. A second lamp base has a second driver. The second lamp base is connected to the second end of the tube lamp. A first socket receives the first lamp base. A second socket receives the second line base. The tube lamp can be linear for U-shaped in a U-shaped bend. The tube lamp can also be formed as a circular bend lamp.

The mode selector switch can be hidden from view when the first connector is installed to the first end cap by being sandwiched between the first connector and the end cap. The intermediate driver mount can also have a first switch body and a second switch body being coplanar with the electrical connector, but insulated from the electrical connector. Preferably, the electrical connector is coplanar to the latching mechanism in the first latch. The first latch is magnetic or mechanical and provides a retaining connection between the first endcap and the first connector. The second driver is preferably redundant to the first driver such that either being operational is sufficient to operate the light element.

Figure 1:
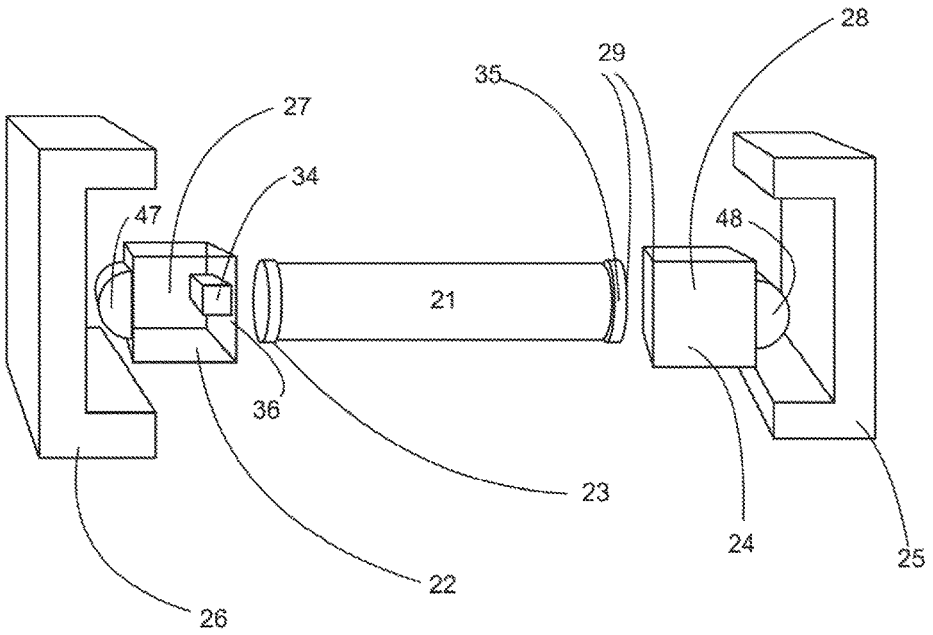
FIG. 1 is a diagram of a linear configuration the present invention.

The following call out list of elements can be as useful guide in referencing the elements of the drawings.

21 Tube
22 First Lamp Base
23 First Endcap
24 Second Lamp Base
25 First Socket
26 Second Socket
27 First Driver
28 Second Driver
29 Connector
31 Switch For Voltage Or Current
32 Electrical Connector
33 Modular Lamp Base Inside Face
34 First Latch
35 Second End Cap
36 First Connector
44 first switch body
45 second switch body
46 toggle switch slide
47 first driver housing contact
48 second driver housing contact
49 toggle switch slide

DETAILED DESCRIPTION OF THE PREFERRED EMBODIMENT

Glossary

LED Light Emitting Diode

As seen in the first figure, a lighting element is formed as a tube. The tube element includes a tube LED lamp shown as a cylindrical tube 21. The tube 21 is preferably a linear LED lighting tube that can simulate a florescent tube lamp for example. The tube 21 is a lighting element. The cylindrical tube 21 has a pair of end caps. The lighting element has a first end cap 23 and a second end cap 35. The first connector 36 connects to the first end cap 23 and the second connector connects to the second end cap 35. The first lamp base 22 connects to the first end cap 23 and the second lamp base 24 connects to the second end cap 35. The first socket 26 receives the first lamp base 22 and the second socket 25 receives the second lamp base 24. A first driver 28 is mounted in the first lamp base 22, and a second driver 27 is mounted in the second lamp base 24. The first end cap 23 and the second end cap 35 can have a circular what area that forms an electrical connector 29 for connecting to the drivers. FIG. 1 shows that the mode selector switch 31 for selecting the voltage or current operation is located on an inside face of the first connector 36. The mode selector switch 31 is hidden from view when the first connector 36 is installed to the first end cap 23.

The drivers are modularly detachable from the cylindrical tube 21. The cylindrical tube 21 can have an array of individual LED elements. The drivers can be housed in plastic injection molded members that have latching means for receiving the end caps. The drivers are therefore replaceable in case of failure. Since there are a pair of drivers, both of them provide a redundant driver function for maintaining electrical power to the cylindrical tube 21 lighting element. The first driver housing of the first driver 27 additionally has a first driver housing contact 47. The driver housing of the second driver 28 additionally has a second driver housing contact 48. The first socket 26 receives the first driver housing contact 47 and makes electrical contact with the first driver housing contact 47. The second socket 25 receives the second driver housing contact 48 and makes electrical contact with the second driver housing contact 48.

The first lamp base 22 connects to the tube 21 by a first latch 34. The first latch 34 is preferably mounted at a lower edge of the first driver 27 or the second driver 28. The first socket 26 can have a cylindrical depression for receiving a cylindrical shaped first lamp base 22. The first lamp base 22 can have a housing that holds a first driver 27. The first driver 27 is preferably electrically connected to a terminal of the first lamp base 22. The first latch 34 can be formed as an extending prong that grips to a first endcap 23 of the tube 21. The first endcap 23 can be formed as a plastic disc that covers an end of the tube 21. The tube 21 can be formed of a transparent glass or plastic material. The tube 21 can have a second endcap 35 formed similarly as the first endcap 23. The second connector 29 connects the second endcap 35 to the second lamp base 24. The second connector 29 can be formed as a pin extending from the first endcap and being moved into the second lamp base 24. The second driver 28 can be mounted within the second lamp base 24. The second socket 25 can formed as a cylindrical hollow for receiving the cylindrically shaped second lamp base 24.

Figure 2:
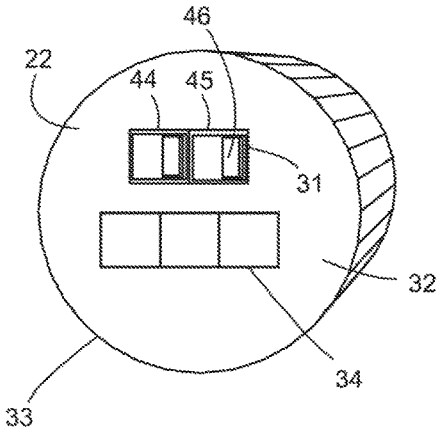
FIG. 2 is a diagram of a modular lamp base inside face showing the connector and optional selection means.

The modular lamp base inside face 33 is formed on an inside face of the first lamp base 22 and on an inside face of the second lamp base 24. The first lamp base 22 has a first connector 36 which is generally the location where the modular lamp base inside face 33 is. The first connector includes an electrical connector 32, and a latch 34. Additionally, a switch 31 for voltage or current can be mounted on a same plane as the electrical connector 32. The switch 31 can be a multiple position switch that can select power between 5 watts up to 55 watts by way of switching voltage for example. The modular lamp base inside face 33 has an electrical connector and optional selection means such as a switch for selecting a mode of operation. The switch 31 can be a sliding toggle switch that has a toggle switch slide 46 where the installer can actuate the toggle switch by sliding the toggle switch slide 46 from left to right. In FIG. 2, the toggle switch is shown as sliding to the right side.

There can be more than one switch and each switch can have more than a pair of positions. For example, the switch 31 can be implemented as a pair of binary switches to provide a four position switch, such as by using a first switch body 44 and a second switch body 45. If the first switch body provides a first pair of modes, and the second switch body provides a second pair of modes, then the switch 31 implemented as a pair of binary switches provides a total of four modes. The first switch body 44 and second switch body 45 face the first endcap 23 and are covered by the first endcap 23. The first switch body 44 and second switch body 45 are coplanar with the electrical connector 32, but insulated from the electrical connector 32. The electrical connector 32 is also preferably coplanar to the latching mechanism in the first latch 34. The first latch 34 can be magnetic or mechanical and provide a retaining connection between the first endcap 23 and the first connector 36.

Figure 3:
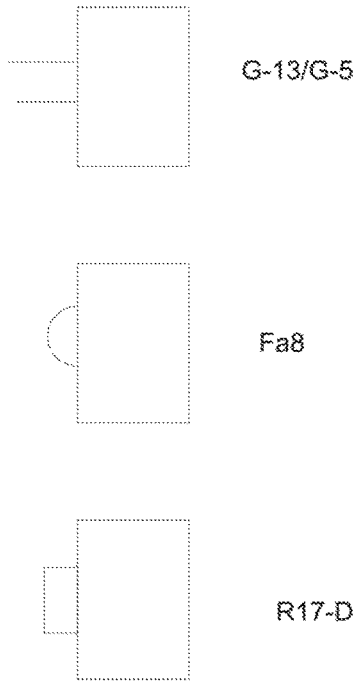
FIG. 3 is a diagram of a variety of different standard physical connection configurations such as G-13, G-5, FA8, R17-D.
Figure 4:
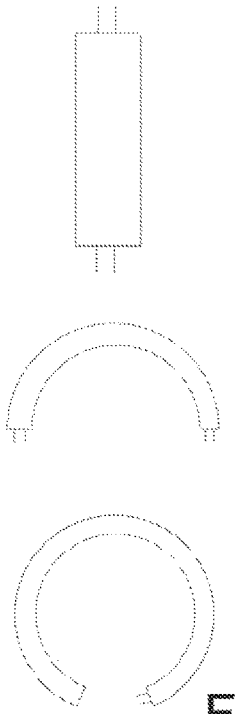
FIG. 4 is a diagram of a variety of different standard shape configurations including straight, bent and circular.

As seen in FIG. 3, the modular LED tube lamp can be implemented in a variety of different standard physical connection configurations such as G-13, G-5, FA8, R17-D. As seen in FIG. 4, the modular LED tube lamp can be implemented as a linear lamp, AU band lamp and a circular band lamp.

A key feature of the present invention is that the tube lamp has a selection mode for the driver so that only one set of driver endcaps is necessary and can adapt to a variety of different lights. The user or factory can switch the LED elements while keeping the driver the same. Also, because there are a pair of drivers on each end, this provides redundancy.

The invention claimed is:

1. A modular LED tube lamp comprising:

a tube lamp having a pair of ends, namely a first end and a second end, wherein the tube lamp includes an array of LED elements;

a first lamp base having a first driver, wherein the first lamp base is connected to the first end of the tube lamp;

a second lamp base having a second driver, wherein the second lamp base is connected to the second end of the tube lamp;

a first socket receiving the first lamp base; and a second socket receiving the second lamp base, wherein a mode selector switch is hidden from view when a first connector is installed to a first end cap.

2. The modular LED tube lamp of claim 1, wherein the tube lamp is linear.

3. The modular LED tube lamp of claim 1, wherein the tube lamp is formed in a U-shaped bend.

4. The modular LED lamp of claim 1, wherein the tube lamp is formed as a circular bend.

5. The modular LED tube lamp of claim 1, wherein the mode selector switch comprises a first switch body and a second switch body which are coplanar with the electrical connector, but insulated from an electrical connector.

6. The modular LED tube lamp of claim 5, wherein the electrical connector is coplanar to a latching mechanism in a first latch, wherein the first latch is magnetic or mechanical and provides a retaining connection between the first endcap and a first connector.

7. The modular LED tube lamp of claim 1, wherein the second driver is configured to be redundant to the first driver.

8. The modular LED tube lamp of claim 7, wherein the tube lamp is linear.

9. The modular LED tube lamp of claim 7, wherein the tube lamp is formed in a U-shaped bend.

10. The modular LED tube lamp of claim 7, wherein the tube lamp is formed as a circular bend.

11. The modular LED tube lamp of claim 7, wherein a mode selector switch is hidden from view between the tube lamp and the first lamp base when a first connector is installed to a first end cap.

12. The modular LED tube lamp of claim 11, wherein a first switch body and a second switch body are coplanar with an electrical connector, but insulated from the electrical connector.

13. A modular LED tube lame of claim 12, wherein an electrical connector is coplanar to the latching mechanism in a first latch, wherein the first latch is magnetic or mechanical and provides a retaining connection between a first endcap and a first connector.

* * * * *